United States Patent [19]

Orbach

[11] Patent Number: 5,036,178

[45] Date of Patent: Jul. 30, 1991

[54] HEATER UNIT FOR HEATING CONTAINER FOR MOIST TISSUES

[76] Inventor: Israel Orbach, 15 Hameyasdim Str., 30900 Zichron Yaacov, Israel

[21] Appl. No.: 493,168

[22] Filed: Mar. 14, 1990

[30] Foreign Application Priority Data

Mar. 17, 1989 [IL] Israel ..... 89646

[51] Int. Cl.[5] ..... H05B 3/74

[52] U.S. Cl. ..... 219/385; 219/521

[58] Field of Search ..... 219/385, 386, 387, 521, 219/433; 215/293; 206/480, 478, 490, 493; 248/313

[56] References Cited

U.S. PATENT DOCUMENTS

| | | | |
|---|---|---|---|
| 2,541,218 | 2/1951 | Doerr | 219/521 |
| 3,212,661 | 10/1965 | Adell | 248/313 |
| 3,432,641 | 3/1969 | Welke | 219/433 |
| 3,837,608 | 9/1974 | Simon | 248/313 |
| 4,009,818 | 3/1977 | Rogers | 248/313 |
| 4,253,013 | 2/1981 | Mabuchi | 219/521 |
| 4,523,083 | 6/1985 | Hamilton | 219/433 |
| 4,694,973 | 9/1987 | Rose | 219/521 |
| 4,700,048 | 10/1987 | Levy | 219/214 |
| 4,890,205 | 12/1989 | Shaffer | 219/214 |

*Primary Examiner*—Teresa J. Walberg
*Attorney, Agent, or Firm*—Benjamin J. Barish

[57] ABSTRACT

A heater unit for heating a supply of moist tissues within a container includes a housing having a top wall for receiving the moist-tissue container, and a bottom wall for stably supporting the housing and the moist-tissue container when received thereon on an flat horizontal surface; and an electrical heater element at the upper end of the housing to heat the moist-tissue container when supported on the housing top wall.

11 Claims, 1 Drawing Sheet

HEATER UNIT FOR HEATING CONTAINER FOR MOIST TISSUES

BACKGROUND OF THE INVENTION

The present invention relates to a heater unit particularly useful for heating containers containing a supply of moist tissues used for refreshing or "dry wiping" purposes.

Moist tissues of the foregoing type are now commonly available. In one form, the moist tissues are contained within individual, sealed envelopes, which envelopes prevent the evaporation of the moisture of the tissue. Such a form of packaging of moist tissues, however, is relatively expensive, and moreover is relatively inconvenient to the user since the user must open each package in order to use the moist tissue therein.

In another type of packaging, a plurality of moist tissues are stacked within a container having an opening enabling each moist tissue to be individually removed as and when desired by the user. While this type of packaging is substantially less expensive than the former type, and is also substantially more convenient to the user, the tissues have a relatively "cold" feeling when applied to the user's face because of the larger rate of evaporation of the moisture within the container.

An object of the present invention is to provide a heater unit particularly useful for heating moist tissues within a container.

OBJECTS AND SUMMARY OF THE INVENTION

According to the present invention, there is provided a heater unit for heating a supply of moist tissues within a container comprising a housing having a top wall for receiving the moist-tissue container, and a bottom wall for stably supporting the housing and the moist-tissue container when received thereon on a flat horizontal surface. The housing comprises two sections secured together, one section including the housing top wall for receiving the moist-tissue container, and the other section including the housing bottom wall for stably supporting the housing on a flat horizontal surface. In addition, one of the housing sections comprises a plurality of pins extending parallel to the longitudinal axis of the housing, and the other housing section comprises a plurality of bores for receiving the pins with a friction fit. The heater unit further includes an electrical heater element in the housing to heat the moist-tissue container when supported on the housing top wall.

It will thus be seen that by providing the electrical heater in a separate heater unit for receiving the moist-tissue container, the heater unit may also be repeatedly used for heating the moist tissues in replacement containers as the supply in each container becomes exhausted.

According to further features in the preferred embodiment of the invention described below, the top wall of the heater unit housing is formed with an upstanding wall of cylindrical configuration serving as a socket for receiving the moist-tissue container. In the described embodiment, the top wall is formed with an annular rib having an upper conical face coaxial with the longitudinal axis of the moist tissue container, and a lower face perpendicular to the longitudinal axis of the moist tissue container, for receiving the moist tissue container with a snap fit.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF A PREFERRED EMBODIMENT

Figure 1:
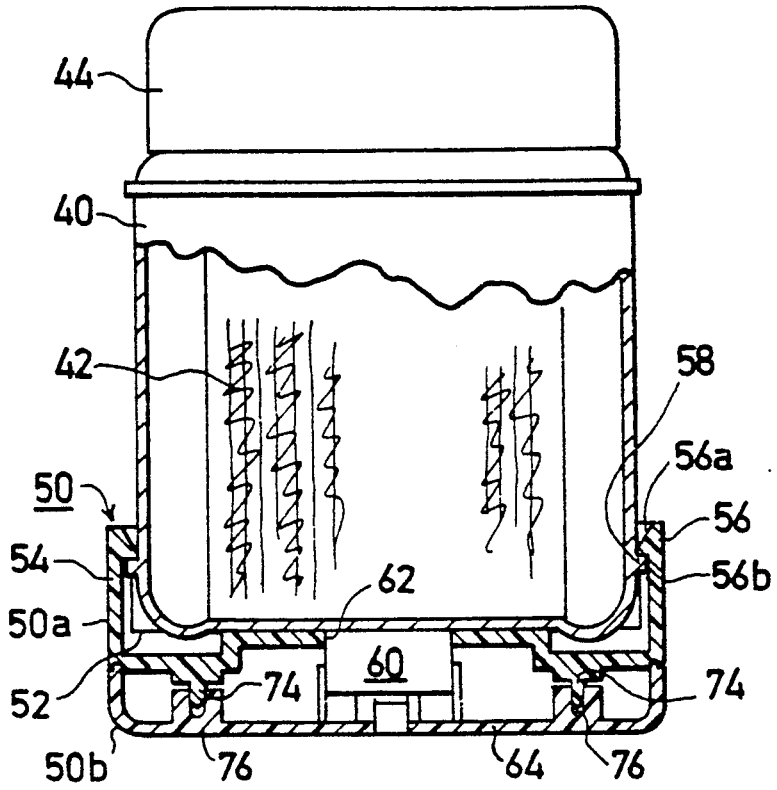
FIG. 1 is a sectional view illustrating one form of heater unit constructed in accordance with the invention receiving a container for a supply of moist tissues which are heated by the heater unit.
Figure 2:
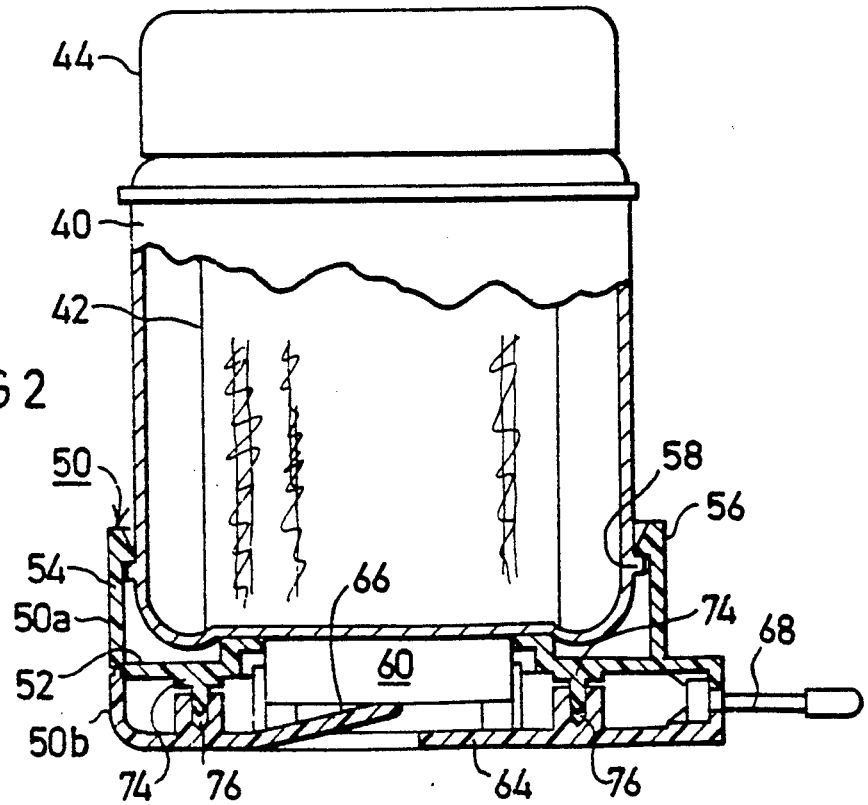
FIG. 2 is a view similar to that of FIG. 1 but rotated 90°.

With reference to the drawings, there is illustrated a container, generally designated 40, containing a supply of moist tissues 42. Each moist tissue may be manually removed from an opening (not shown) in the top wall of container 40, which opening is normally closed by a cap 44. Container 40 is of cylindrical configuration and is attachable to a heater unit housing, generally designated 50, which includes a top wall 52 formed with an upstanding wall 54 of cylindrical configuration serving as a socket for receiving the bottom of the container.

The upper end of cylindrical wall 54 is formed with an annular rib 56 having an upper conical face **56*a* coaxial with the longitudinal axis of the housing 50 and the moist tissue container 40, when received therein. Rib 56 is further formed with a lower face 56*b* perpendicular to the longitudinal axis of the heater unit and container 40. The outer face of container 40 is formed with an annular rib 58, which is adapted to be received by rib 56 of the heater unit 50** with a snap fit.

An electrical heating element 60 is disposed within the housing 50 of the heater unit, adjacent to its top wall 52. Preferably, the housing top wall 52 is formed with a central opening 62 in alignment with the electrical heating element 60, to permit the heating element to project through the opening and thus to be close, and in good heat-exchange relation, to the bottom wall of the moist-tissue container 40. The electrical heating element 60 is spaced from the bottom wall 64 of the heater unit housing by a ledge 66 integrally formed with the bottom wall. Bottom wall 64 is flat to permit it, together with the moist- tissue container 40 applied thereon, to be stably supported on a flat horizontal surface.

The housing 50 for the heater unit further includes a plug 68 projecting laterally from a side wall of the housing for connecting the electrical heating element 60 to a source of electrical power. It will be appreciated that the plug 68 could be attached to the end of a cord (not shown) carried by the heater unit, rather than being fixed to the side wall of the heater unit. The heater unit may also be provided with an electric light indicator (not shown) to indicate when it is energized, and a sight window (not shown) to permit viewing the indicator light.

In the described embodiment, the housing 50 of the heater unit is constituted of two sections **50*a*, 50*b*, secured together. The upper section 50*a* is formed with the top wall 52 and the upstanding cylindrical wall 54 for receiving the moist-tissue container 40; whereas the lower housing section 50*b* is formed with the bottom wall 64, the ledge 66 for supporting the electrical heating element 62, and the plug 68. The two sections are secured together by a plurality of pins 74 depending from the lower face of the upper section 50***a*, each received by a friction fit within a blind bore 76 formed in the lower housing section 50*b*.

It will thus be seen that the invention provides a heater unit which may be repeatedly reused for heating moist-tissue containers, thereby saving the substantial expense that would be involved if a separate heater unit is required to be included in each such container. Further, the heater unit is constructed to transfer maximum heat to the moist tissues within the containers, and includes but a few simple parts which can be manufactured and assembled in volume and at low cost.

While the invention has been described with respect to one preferred embodiment, it will be appreciated that many variations, modifications and other applications of the invention may be made.

What is claimed is:

1. A heater unit for heating a supply of moist tissues within a container, comprising: a housing having a top wall for receiving the moist-tissue container, and a bottom wall for stably supporting the housing, and the moist-tissue container when received thereon, on a flat horizontal surface; said housing comprising two sections secured together, with one section including the housing top wall for receiving the moist-tissue container, and the other section including the housing bottom wall for stably supporting the housing on a flat horizontal surface; one of said housing sections comprising a plurality of pins extending parallel to the longitudinal axis of the housing, and the other housing section comprising a plurality of bores for receiving said pins with a friction fit; and an electrical heater element at the upper end of the housing to heat the moist-tissue container when supported on said housing top wall.

2. This heater unit according to claim 1, further including an electrical plug carried by the housing for connecting the electrical heater element to a source of electrical power.

3. The heater unit according to claim 1, wherein said top wall of the housing includes a socket defined by an upstanding wall of cylindrical configuration, for receiving the cylindrical portion at the bottom of the moist-tissue container.

4. The heater unit according to claim 1, wherein said top wall is formed with an annular rib having an upper conical face coaxial with the longitudinal axis of the moist tissue container, and a lower annular face perpendicular to the longitudinal axis of the moist tissue container, for receiving the moist tissue container with a snap fit.

5. The heater unit according to claim 1, wherein the lower housing section includes a ledge integrally formed with its bottom wall engageable with the heating element for supporting the heating element adjacent to the top wall of the upper housing section.

6. The combination of a heater unit according to claim 1, together with a moist-tissue container received on the upper wall of the heater unit.

7. A heater unit for heating a supply of moist tissue within a container, comprising: a housing having a top wall formed with a socket defined by an upstanding cylindrical wall for receiving the bottom portion of the moist-tissue container, and a bottom wall for stably supporting the housing and the moist-tissue container when received thereon on a flat horizontal surface; and an electrical heater element at the upper end of the housing to heat the moist-tissue container when supported on said housing top wall; said top wall being formed with an annular rib having an upper conical face coaxial with the longitudinal axis of the moist tissue container, and a lower face perpendicular to the longitudinal axis of the moist tissue container, for receiving the moist tissue container with a snap fit.

8. The heater unit according to claim 6, wherein the housing comprises two sections secured together, one section including the housing top wall for receiving the moist-tissue container, and the other section including the housing bottom wall for stably supporting the housing on a flat horizontal surface.

9. The heater unit according to claim 7, wherein the two housing sections are secured together by a friction fit.

10. The heater unit according to claim 8, wherein one of said sections comprises a plurality of pins extending parallel to the longitudinal axis of the housing, and the other section comprises a plurality of bores for receiving said pins with a friction fit.

11. The heater unit according to claim 8, wherein the lower housing section includes a ledge integrally formed with its bottom wall engageable with the heating element for supporting the heating element adjacent to the top wall of the upper housing section.

* * * * *